US006981626B1

(12) United States Patent
Tsai

(10) Patent No.: US 6,981,626 B1
(45) Date of Patent: Jan. 3, 2006

(54) STAPLER WITH A LEG-CUTTING DEVICE

(75) Inventor: Eric Tsai, Ta-Li (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 0 days.

(21) Appl. No.: 11/006,587

(22) Filed: Dec. 8, 2004

(51) Int. Cl.
*B25L 5/02* (2006.01)
*B27F 7/23* (2006.01)

(52) U.S. Cl. ..... 227/79; 227/155

(58) Field of Classification Search ..... 227/131, 227/134, 155, 76, 79, 61
See application file for complete search history.

(56) References Cited

U.S. PATENT DOCUMENTS 2,083,227 A * 6/1937 Drypolcher ..... 227/76
4,199,095 A * 4/1980 Yamanoi ..... 227/125
4,378,085 A * 3/1983 McVeigh ..... 227/79
4,593,847 A * 6/1986 Hagemann ..... 227/155
4,844,319 A * 7/1989 Kurosawa ..... 227/79
5,413,266 A * 5/1995 Jairam ..... 227/129
5,586,710 A * 12/1996 Golicz ..... 227/155
5,791,543 A * 8/1998 Udagawa et al. ..... 227/4
6,036,074 A * 3/2000 Manabe ..... 227/155
6,250,531 B1 * 6/2001 Yagi ..... 227/79
6,698,640 B2 * 3/2004 Hakozaki et al. ..... 227/4
6,935,547 B2 * 8/2005 Mochizuki ..... 227/131

* cited by examiner

*Primary Examiner*—Scott A. Smith
(74) *Attorney, Agent, or Firm*—Rosenberg, Klein & Lee

(57) ABSTRACT

A stapler has a main base, a pivotal base, a recoiling device, a stapling device, a connecting device and a leg-cutting device. The leg-cutting device is mounted between the main base and the pivotal base and has an upper base, a lower base, two arm holders, two pushing arms, a cutting pad, two cutting blocks, two guiding blocks and two biasing members. The lower base has an arm-lifting top surface. The pushing arms are pivotally connected to the arm holders and each has a sliding end slidably attached to the arm-lifting top surface of the lower base and a pushing end. The cutting blocks are attached respectively to the pushing ends of the pushing arms. The guiding blocks are slidably mounted on the pivotal base and are driven by the cutting blocks.

19 Claims, 9 Drawing Sheets

STAPLER WITH A LEG-CUTTING DEVICE

BACKGROUND OF THE INVENTION

1. Field of the Invention

The present invention relates to a stapler, and more particularly to a stapler with a leg-cutting device whereby legs of a staple can be bent and excess portions cut off.

2. Description of Related Art

A stapler is an important office tool and is used to bind multiple document sheets together with a staple. However, the amount of sheets to be stapled may vary considerably such that the thickness of the pile needs to be taken into special consideration. Thus, a stapler is commonly supplemented with a leg-cutting device to cut off redundant parts of legs of a staple. With reference to FIG. 9, a conventional leg-cutting device substantially comprises two pivotal bending arms (80) and a cutting pad (82). Each bending arm (80) has a bending surface (802) formed on the top. When a user uses a stapler with the conventional leg-cutting device and presses a handle of the stapler downward, a stapler will be pushed out of a staple magazine by a driving tab. After the legs of a staple have been extended through sheets of paper, the legs of the staple will be bent along the bending surfaces (802) on the bending arms (80). The bending arms (80) will pivotally rotate to cut off redundant parts of the legs in cooperation with the cutting pad (82).

However, because the bending surfaces (802) on the bending arms (80) are inclined flat surfaces, the use must press the handle of the stapler with a large force for bending the legs of a staple along the inclined bending surfaces (802). Furthermore, the movement of the bending arms of the conventional leg-cutting device is in a curved path, and to cut off the legs with the curved movement of the bending arms takes a large force. In addition, the curved movement of the bending arms cannot make the cut legs actually flush with the sheets of the papers, so the use of a stapler with a conventional leg-cutting device is not convenient.

To overcome the shortcomings, the present invention tends to provide a stapler to mitigate or obviate the aforementioned problems.

SUMMARY OF THE INVENTION

The main objective of the invention is to provide a stapler that can cut off excess portions of staple legs conveniently. The stapler has a main base, a pivotal base, a recoiling device, a stapling device, a connecting device and a leg-cutting device. The pivotal base is pivotally attached to the main base with a first pivot. The recoiling device is mounted between the main base and the pivotal base to push the pivotal base to an original position. The stapling device is attached to the pivotal base and has a connecting bracket, a staple magazine, a handle assembly and a driving tab. The connecting bracket is attached to the pivotal base. The staple magazine is pivotally attached to the connecting bracket to receive multiple staples inside the staple magazine. The handle assembly is connected to the staple magazine. The driving tab is connected to the handle assembly and extends into the staple magazine. The connecting device is mounted between the main base and connecting bracket to rotate the pivotal base downward when the handle assembly is pressed. The leg-cutting device is mounted between the main base and the pivotal base and has an upper base, a lower base, two arm holders, two pushing arms, a cutting pad, two cutting blocks, two guiding blocks and two biasing members. The upper base is securely attached to the pivotal base and has at least one through hole. The lower base is securely attached to the main base, corresponds to the upper base and has an arm-lifting top surface. The arm holders are securely attached to the pivotal base and extend toward the main base. The pushing arms are pivotally connected to the arm holders respectively and each has a sliding end slidably attached to the arm-lifting top surface of the lower base and a pushing end. The cutting pad is attached to the upper base and corresponds to the driving tab. The cutting blocks are attached respectively to the pushing ends of the pushing arms and align with the at least one through hole in the upper base. The guiding blocks are slidably mounted on the pivotal base and each has a curved guiding top surface. The curved guiding top surface is formed on the guiding block at one end facing to the other guiding block. The biasing members are mounted in the pivotal base and abut respectively against the guiding blocks.

Other objects, advantages and novel features of the invention will become more apparent from the following detailed description when taken in conjunction with the accompanying drawings.

DETAILED DESCRIPTION OF PREFERRED EMBODIMENT

Figure 1:
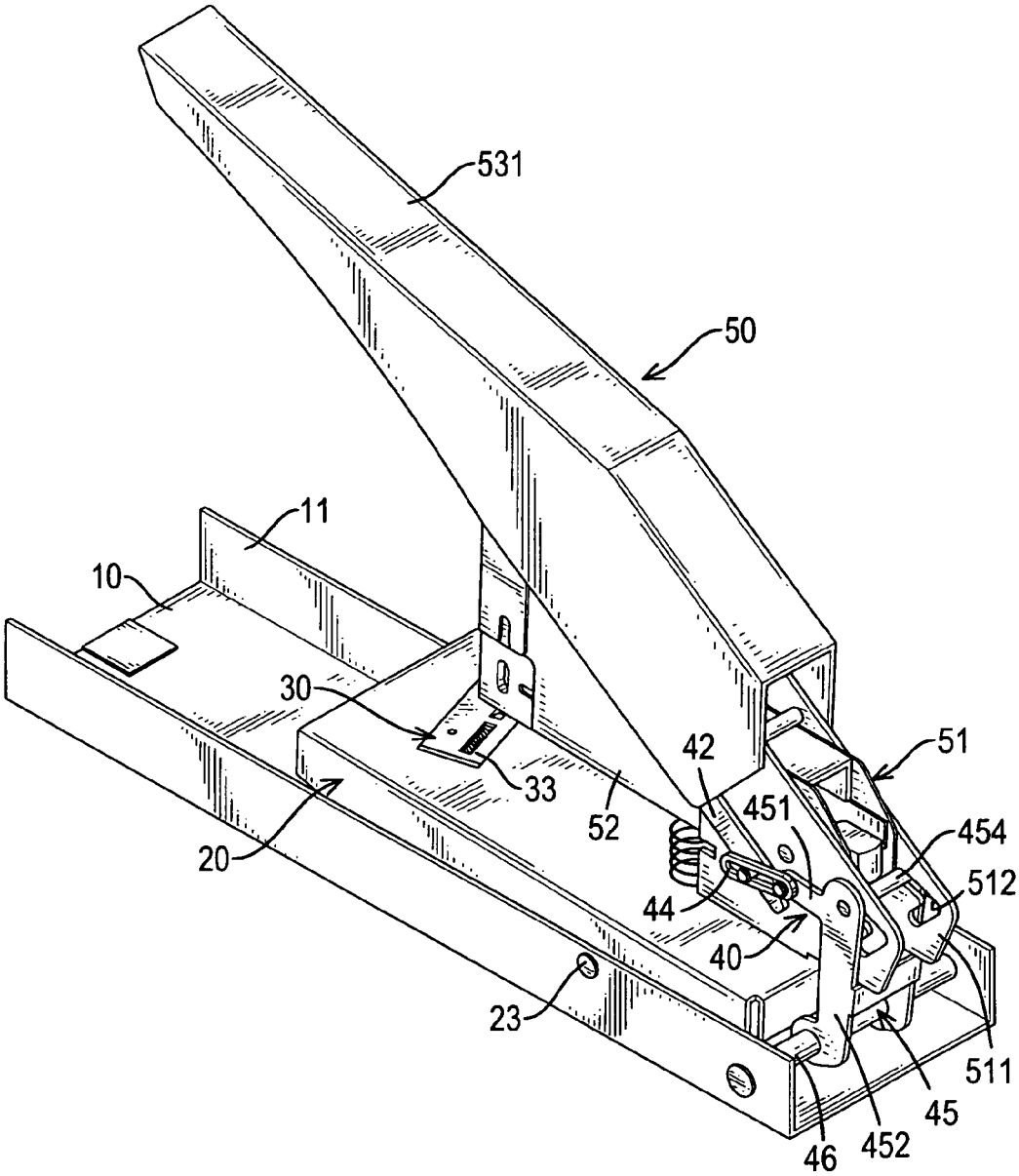
FIG. 1 is a perspective view of a stapler in accordance with the present invention.
Figure 2:
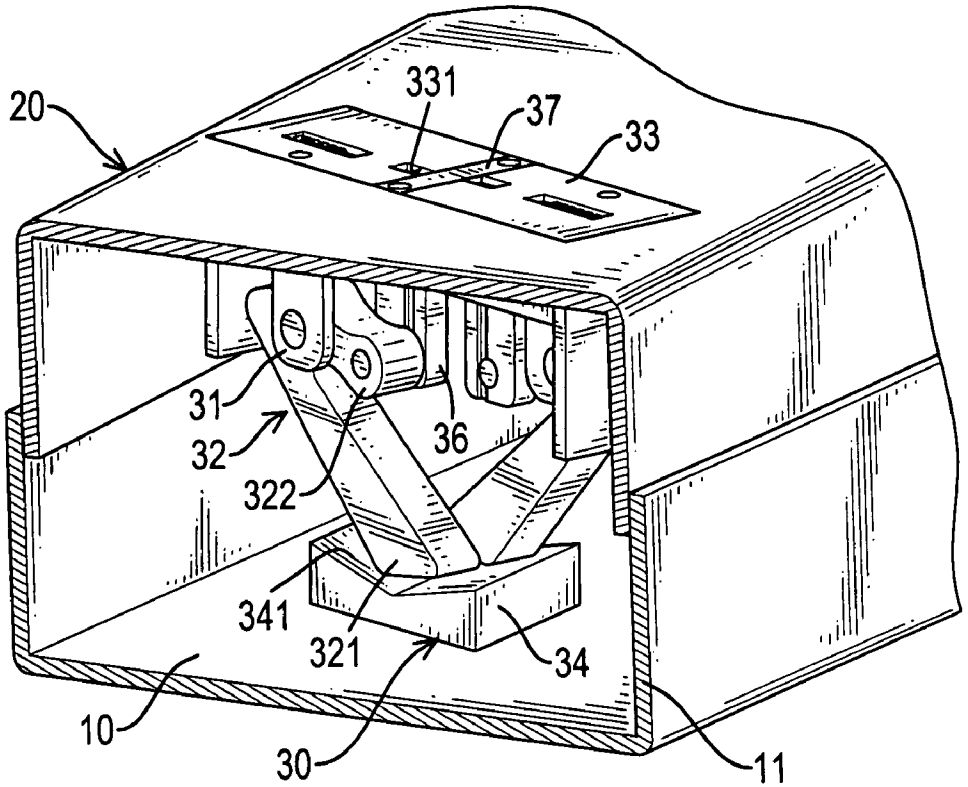
FIG. 2 is a perspective view in partial cross section of a leg-cutting device of the stapler in FIG. 1.
Figure 3:
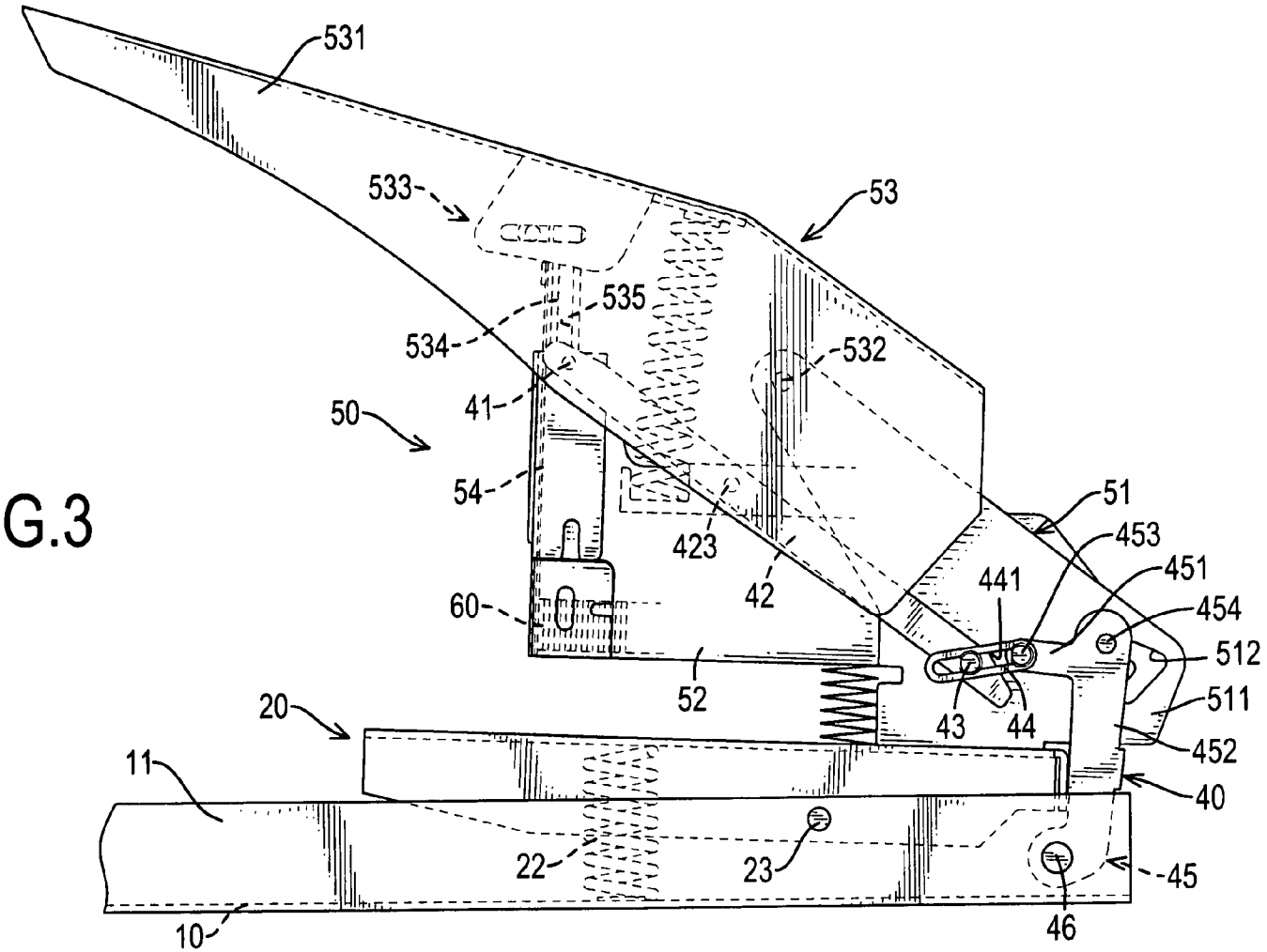
FIG. 3 is a side plan view of the stapler in FIG. 1.

With reference to FIGS. 1 to 3, a stapler in accordance with the present invention comprises a main base (10), a pivotal base (20), a recoiling device (22), a leg-cutting device (30), a connecting device (40) and a stapling device (50). The main base (10) is U-shaped and has two wings (11).

The pivotal base (20) is pivotally attached to the main base (10) between the wings (11) with a first pivot (23). The recoiling device (22) is mounted between the main base (10) and the pivotal base (20) to push the pivotal base (20) to an original position. In a preferred embodiment, the recoiling device (22) is a spring.

The stapling device (50) is attached to the pivotal base (20) and comprises a connecting bracket (51), a staple magazine (52), a handle assembly (53) and a driving tab (54). The connecting bracket (51) is attached to the pivotal base (20) and comprises two side plates (511) parallel with each other. Each side plate (511) has a positioning channel (512) aligning with the positioning channel (512) in the other side plate (511).

The staple magazine (52) is pivotally attached to the connecting bracket (51) between the side plates (511) to receive staples (60) inside the staple magazine (52).

The handle assembly (53) is connected to the staple magazine (52). The handle assembly (53) has a handle (531) and a guiding device (533). The handle (531) is pivotally attached to the connecting bracket (51) with a second pivot (532). The guiding device (533) is attached to the handle (531) and has a slider (534). The slider (534) is connected to the handle (531), extends slidably into the staple magazine (52) in a longitudinal direction and has a longitudinal channel (535) along the longitudinal direction.

The driving tab (54) is connected to the handle assembly (53) and extends into the staple magazine (52). The driving tab (54) is attached to the slider (534) to push a corresponding staple (60) out of the staple magazine (52).

The connecting device (40) is mounted between the main base (10) and the connecting bracket (51) and comprises a pivotal bracket (45), two connecting levers (42), a first sliding pin (41), two second sliding pins (43), two third sliding pins (453) and two linkers (44). The pivotal bracket (45) is pivotally attached to the main base (10) with a third pivot (46) and has two pivotal arms (452). The pivotal arms (452) are located respectively at two sides of the connecting bracket (51) and each has a connecting end (451) away from the third pivot (46). The third sliding pins (453) are attached respectively to the connecting ends (451) of the pivotal arms (452). A positioning pin (454) is mounted between the pivotal arms (452) and extends through the positioning channels (512) in the connecting bracket (51).

Each connecting lever (42) has a first end, a second end and a middle. The middles of the connecting levers (42) are pivotally connected to the staple magazine (52) with a fourth pivot (423). The first sliding pin (41) is mounted between the first ends of the connecting levers (42) and slidably extends through the longitudinal channel (535) in the slider (534). The second sliding pins (43) are attached respectively to the second ends of the connecting levers (42).

The linkers (44) are pivotally and slidably connected respectively to the connecting ends (451) of the pivotal arms (452) of the pivotal bracket (45) with the third sliding pins (453). Each linker (44) has a sliding channel (441) to hold the second sliding pin (43) and the third sliding pin inside (453), such that the linker (44) is pivotally and slidably connected to the second end of the corresponding connecting lever (42).

Figure 4:
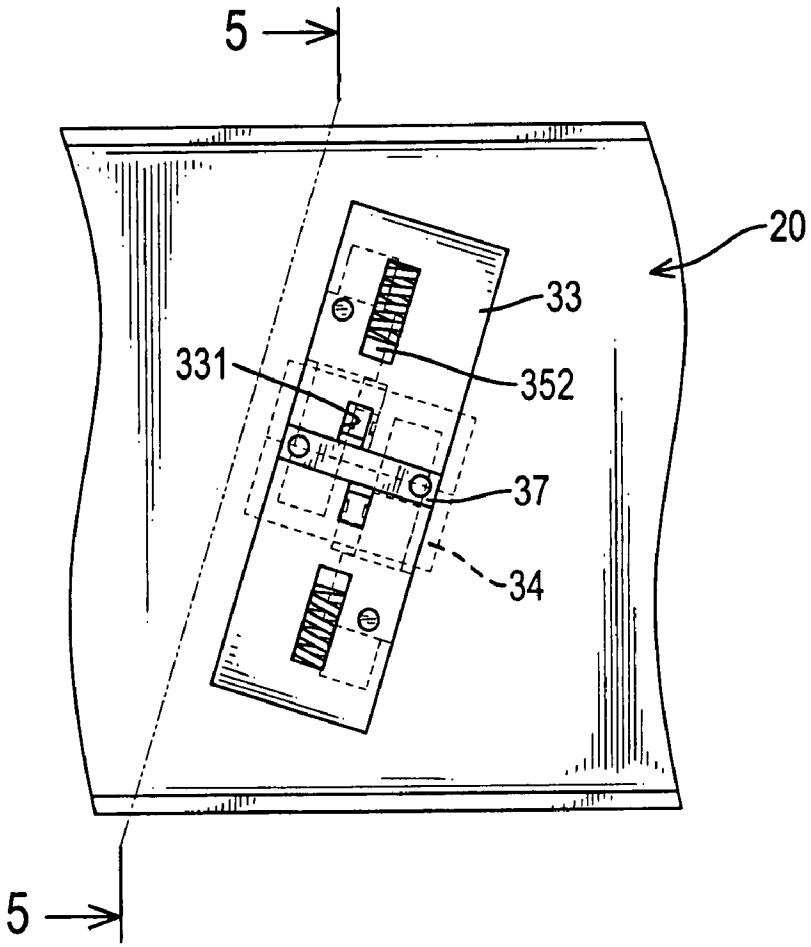
FIG. 4 is an enlarged partial top plan view of the stapler in FIG. 1.
Figure 5:
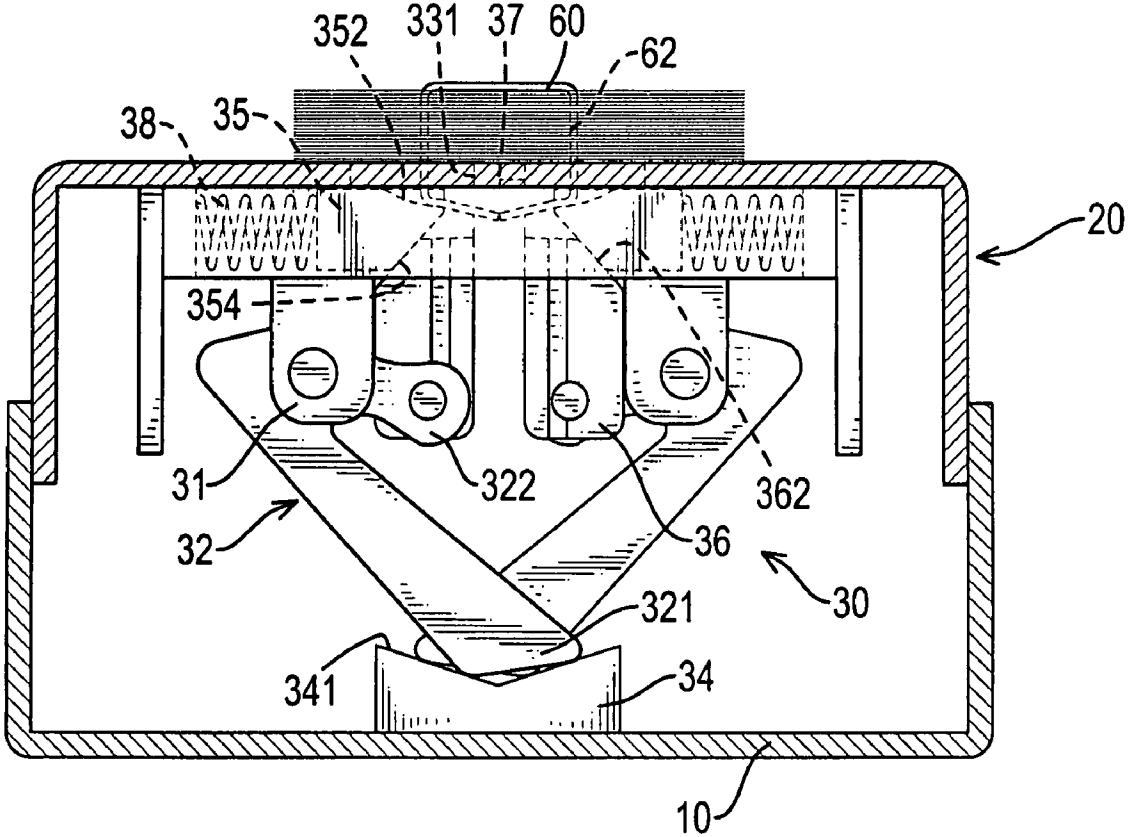
FIG. 5 is an operational side plan view in partial cross section of the stapler along line 5—5 FIG. 4.
Figure 6:
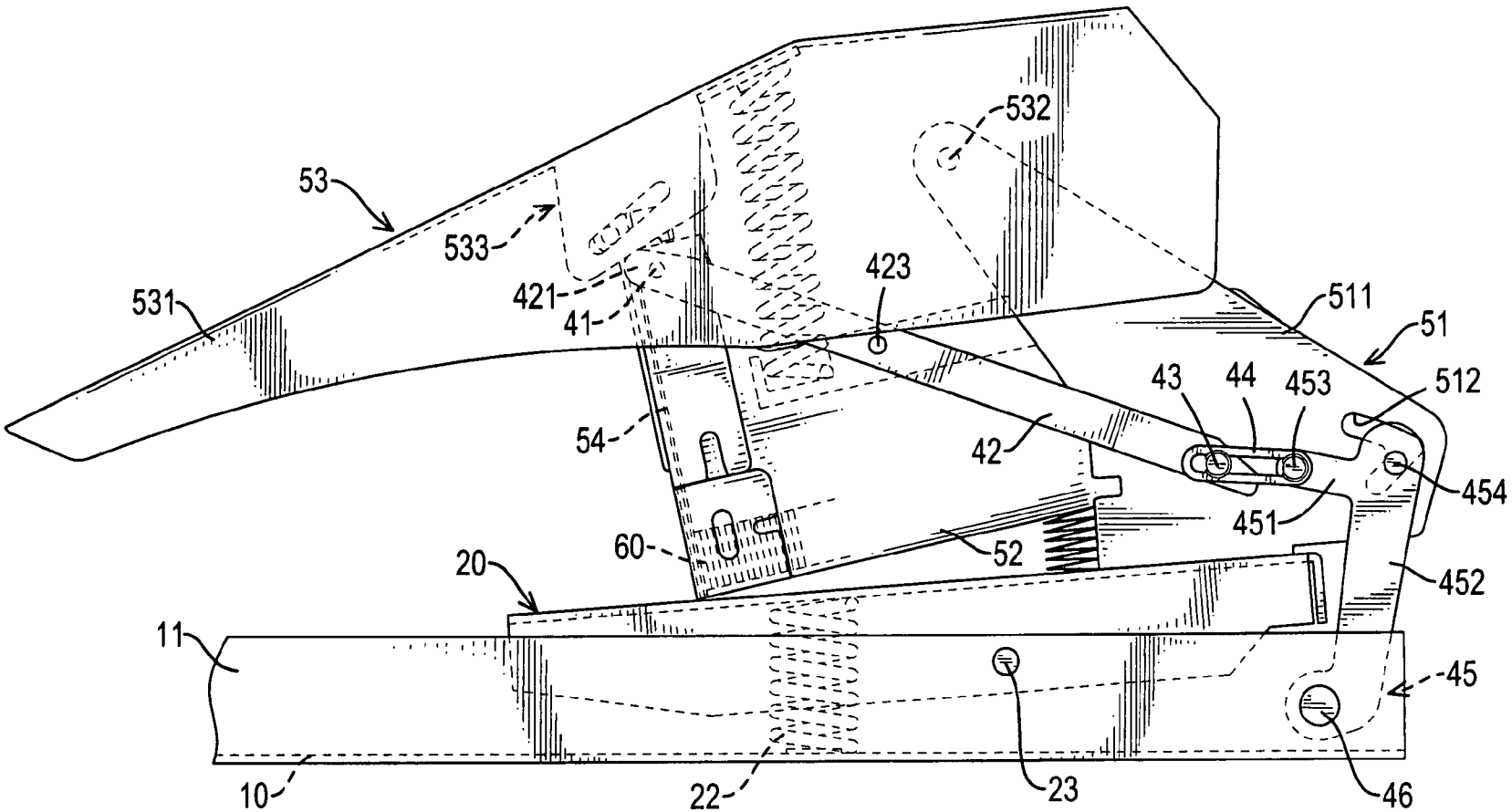
FIG. 6 is an operational side plan view of the stapler in FIG. 1.
Figure 7:
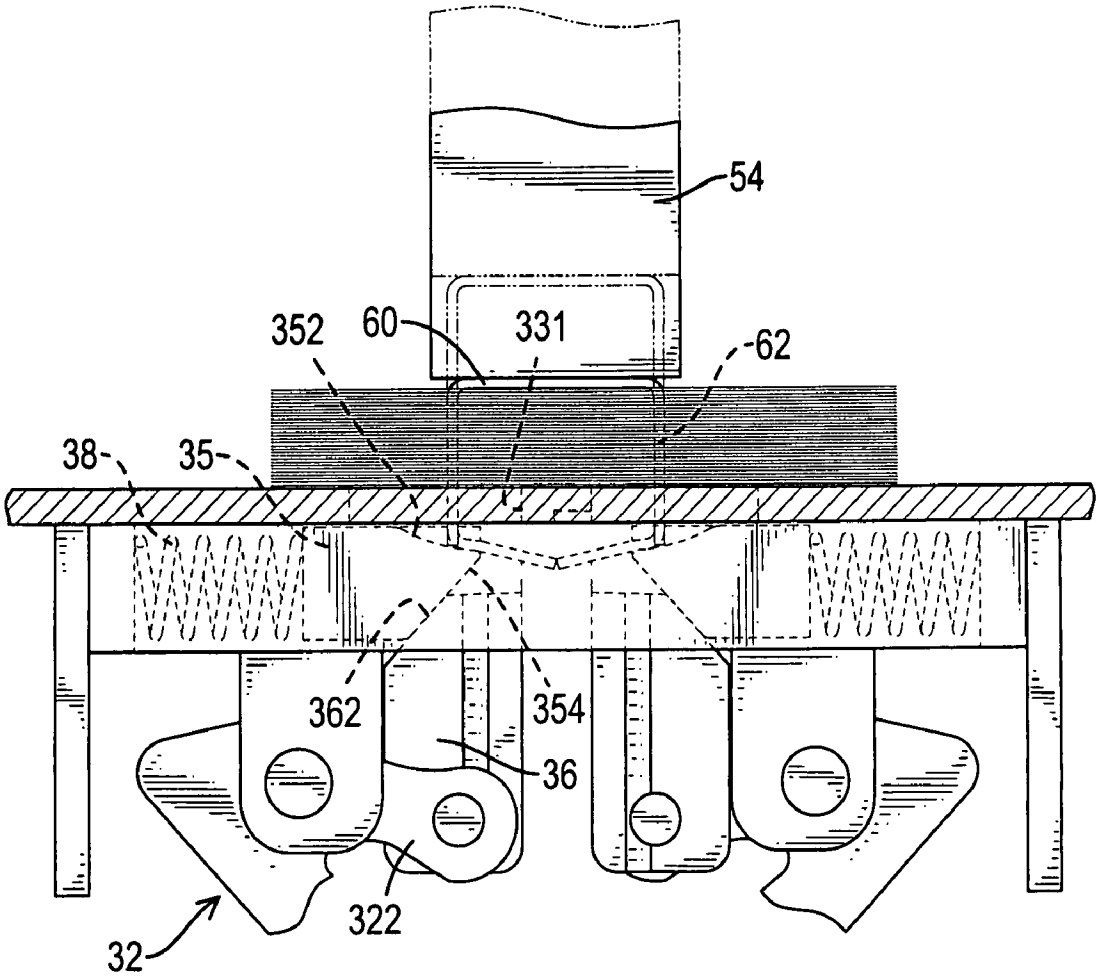
FIG. 7 is an operational enlarged partial side plan view of the leg-cutting device of the stapler in FIG. 1.
Figure 8:
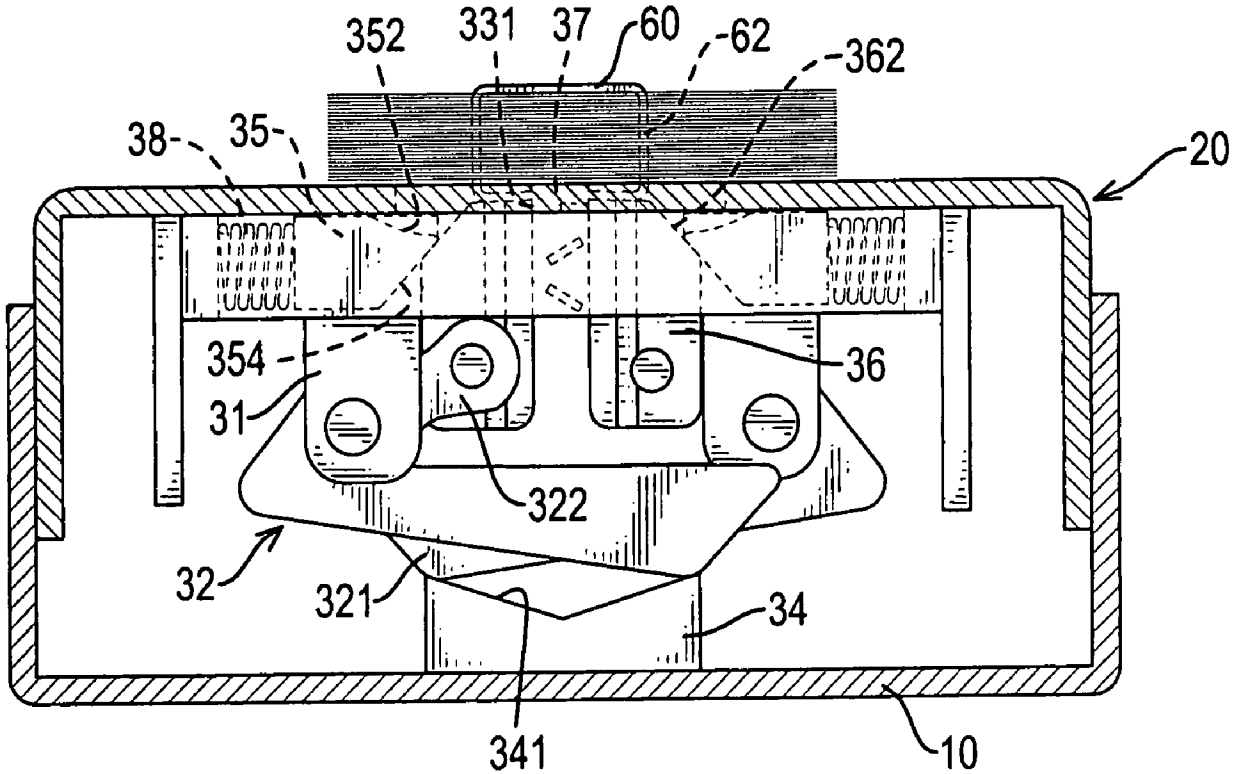
FIG. 8 is an operational side plan view in partial cross section of the stapler in FIG. 1 showing that excess portions of the legs of a staple are cut off by the leg-cutting device.
Figure 9:
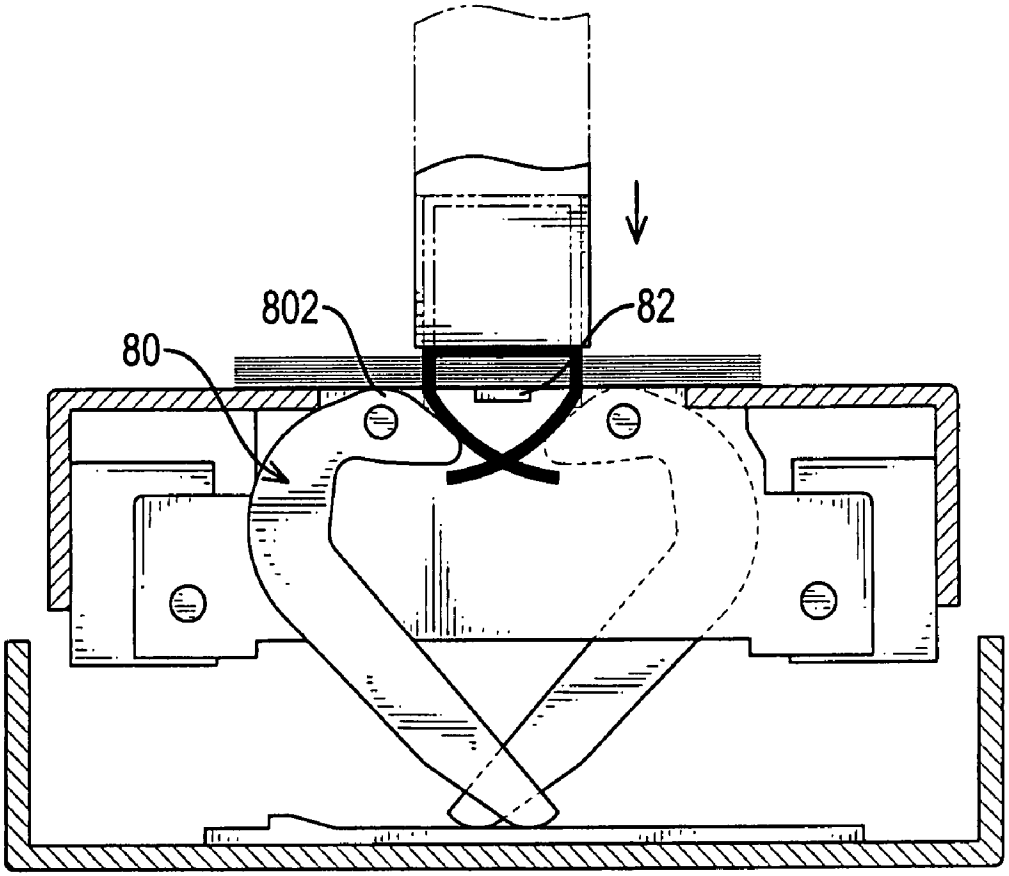
FIG.9 PRIOR ART
FIG. 9 is an operational side plan view of a conventional leg-cutting device for a stapler in accordance with the prior art.

With reference to FIGS. 2, 4 and 5, the leg-cutting device (30) is mounted between the main base (10) and the pivotal base (20) and comprises two arm holders (31), an upper base (33), two pushing arms (32), two cutting blocks (36), a lower base (34), a cutting pad (37), two guiding blocks (35) and two biasing members (38).

The arm holders (31) are attached to the pivotal base (20) and extend toward the main base (10). The upper base (33) is secured to the pivotal base (20) and has at least one through hole (331) defined through the upper base (33) and aligning with legs (62) of a staple (60) received in the staple magazine (52). In a preferred embodiment, the upper base (33) has two through holes (331) aligning respectively with the legs (62) of the corresponding staple (60). The pushing arms (32) are pivotally connected to the arm holders (31) respectively and each has a sliding end (321) and a pushing end (322). The cutting blocks (36) are attached respectively to the pushing ends (322) of the pushing arms (32) and align respectively with the through holes (331) in the upper base (33). Each cutting block (36) has a sliding surface (362) formed on the top of the block (36) at a corner away from the other block (36). In a preferred embodiment, the sliding surface (362) is an inclined surface.

The lower base (34) is secured to the main base (10) and corresponds to the upper base (33). The lower base (34) has an arm-lifting top surface (341), and the sliding ends (321) of the pushing arms (32) are slidably attached to the arm-lifting top surface (341) of the lower base (34). When the pivotal base (20) moves downward, the sliding ends (321) will move along the arm-lifting top surface (341) to make the pushing arms (32) move upward. In a preferred embodiment, the arm-lifting top surface (341) is a V-shaped surface or a concave surface.

The cutting pad (37) is attached to the upper base (33) between the through holes (331) and corresponds to the driving tab (54). The cutting pad (37) has a bottom and a protrusion extending from the bottom to form a first cutting edge at the bottom and a second cutting edge at the protrusion. Accordingly, the first cutting edge and the second edge are located respectively at horizontal levels and correspond respectively to the cutting blocks (36).

The guiding blocks (35) are slidably mounted on the pivotal base (20) and each has a curved guiding top surface (352) formed on the guiding block (35) at one end facing to the other guiding block (35). Each guiding block (35) has a sliding face (354) formed on the bottom of the guiding block (35) at one end with the guiding top surface (352) and abutting against the sliding surface (362) of a corresponding cutting block (36). In a preferred embodiment, the sliding surface (354) is an inclined surface abutting against the inclined sliding surface (362) on the corresponding cutting block (36). The biasing members (38) are mounted in the pivotal base (20) and abut respectively against the guiding blocks (35).

To bind sheets of paper with a staple (60), with reference to FIGS. 1, 3 and 5 to 8, the handle (531) is pushed downward. The driving tab (54) will move downward with the transmission of the guiding device (533) to push a corresponding staple (60) out of the staple magazine (52). The legs (62) of the staple (60) will penetrate through the through holes (531) in the upper base (53) and will be bent along the curved guiding top surfaces (352) on the guiding blocks (35).

At this time, the connecting levers (42) will pivotally rotate relative to the staple magazine (52) at the fourth pivot (532), and the first sliding pin (41) slides along the longitudinal channel (535) in the slider (534). The pivotal bracket (45) will pivotally rotate relative to the main base (10) with the transmission of the linkers (44) when the connecting levers (42) pivotally rotate. With the rotation of the pivotal bracket (45), the positioning pin (454) will slide along the positioning channels (512) in the connecting bracket (51). The connecting bracket (51) will be rotated with the pivotal bracket (45), and the pivotal base (20) will pivotally rotate downward relative to the main base (10).

With the downward rotation of the pivotal base (20), the arm holders (31) will move downward with the pivotal base (20). The sliding ends (321) of the pushing arms (32) will move along the arm-lifting top surface (341) of the lower base (34), and the pushing ends (322) of the pushing arms (32) with the cutting blocks (36) will move upward. With the upward movement of the cutting blocks (36), the guiding blocks (35) will move apart from each other with the arrangements of the inclined surfaces (354, 362) on the guiding blocks (35) and the cutting blocks (36). Accordingly, the cutting blocks (36) will cut off redundant parts of the legs (62) in cooperation with the cutting pad (37), and the cutting blocks (36) will press the cut legs (62) to become flush with the sheets to keep any person from being injured by the cut legs (62). With the curved guiding surfaces (352) on the guiding blocks (35), to press the handle (531) for bending the legs (62) of the stapler (60) along the curved guiding surfaces (352) takes a small force. With the arrangement of the cutting edges on the cutting pad (37), times for the cutting blocks achieving the corresponding cutting edges are different. Accordingly, the legs (62) of the staple (60) will be cut off at different times. This will allow the user to apply a small force for using the stapler because the user does not have to exert a large force to cut off both legs at the same time. In addition, because the legs (62) have been bent before being cut off and the movement of the cutting blocks (36) is along a straight path, to cut off the bent legs (62) takes much less force than that taken by a conventional leg-cutting device so that the use of the leg-cutting device (30) is convenient.

After the user releases the handle (531), the pivotal base (20), the stapling device (50) and the connecting device (40) will return to an original position. The pushing ends (322) of the pushing arms (32) with the cutting blocks (36) will move downward, and the guiding blocks (35) will move backward to the original position with the force provided by the biasing member (38).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stapler comprising:

a main base;

a pivotal base pivotally attached to the main base with a first pivot;

a recoiling device mounted between the main base and the pivotal base to push the pivotal base to an original position;

a stapling device attached to the pivotal base and comprising a connecting bracket attached to the pivotal base, a staple magazine pivotally attached to the connecting bracket to receive multiple staples inside the staple magazine;

a handle assembly connected to the staple magazine; and a driving tab connected to the handle assembly and extending into the staple magazine;

a connecting device mounted between the main base and the connecting bracket to rotate the pivotal base downward when the handle assembly is pressed;

a leg-cutting device mounted between the main base and the pivotal base and comprising an upper base securely attached to the pivotal base and having at least one through hole;

two arm holders securely attached to the pivotal base and extending toward the main base;

two pushing arms pivotally connected to the arm holders respectively and each pushing arm having a sliding end and a pushing end;

a lower base securely attached to the main base, corresponding to the upper base and having an arm-lifting top surface, wherein the sliding ends of the pushing arms are slidably attached to the arm-lifting top surface of the lower base to make the pushing arms to move upward when the pivotal base with the arm holders moves downward;

a cutting pad attached to the upper base, corresponding to the driving tab and having a bottom and a protrusion extending from the bottom to form a first cutting edge at the bottom and a second cutting edge at the protrusion;

two cutting blocks attached respectively to the pushing ends of the pushing arms and aligning with the at least one through hole in the upper base, two guiding blocks slidably mounted on the pivotal base and driven by the cutting blocks to move in a lateral direction while the cutting blocks moves, and each guiding block having a curved guiding top surface formed on the guiding block at one end facing to the other guiding block; and two biasing members mounted in the pivotal base and abutting respectively against the guiding blocks to provide the guiding blocks resilient forces.

2. The stapler as claimed in claim 1, wherein the main base is U-shaped and has two wings; and the pivotal base is pivotally attached to the main base between the wings.

3. The stapler as claimed in claim 2, wherein the recoiling device is a spring.

4. The stapler as claimed in claim 3, wherein the connecting bracket has two side plates parallel with each other:

each side plate having a positioning channel aligning with the positioning channel in the other side plate; and the staple magazine is pivotally attached to the connecting bracket between the side plates.

5. The stapler as claimed in claim 4, wherein the handle assembly comprises a handle pivotally attached to the connecting bracket with a second pivot; and a guiding device attached to the handle and having a slider connected to the handle, extending into the staple magazine in a longitudinal direction and having a longitudinal channel along the longitudinal direction; and the driving tab is attached to the slider to push a corresponding staple out of the staple magazine.

6. The stapler as claimed in claim 5, wherein the connecting device comprises a pivotal bracket pivotally attached to the main base with a third pivot and having two pivotal arms, wherein the pivotal arms are located respectively at two sides of the connecting bracket and each pivotal arm has a connecting end away from the third pivot;

two connecting levers pivotally connected to the staple magazine and each connecting lever having a first end, a second end and a middle pivotally connected to the staple magazine with a fourth pivot;

a first sliding pin mounted between the first ends of the connecting levers and slidably extending through the longitudinal channel in the slider;

two second sliding pins attached respectively to the second ends of the connecting levers;

two third sliding pins attached respectively to the connecting ends of the pivotal arms;

a positioning pin mounted between the pivotal arms and extending through the positioning channels in the connecting bracket;

two linkers pivotally and slidably connected respectively to the connecting ends of the pivotal arms of the pivotal bracket with the third sliding pins and each linker having a sliding channel to hold a corresponding second sliding pin and a corresponding third sliding pin inside the sliding channel.

7. The stapler as claimed in claim 6, wherein the arm-lifting top surface is a V-shaped surface.

8. The stapler as claimed in claim 7, wherein each cutting block has a sliding surface formed on the top of the cutting block at a corner away from the other cutting block; and each guiding block has a sliding face formed on the bottom of the guiding block at one end with the guiding top surface and abutting against the sliding surface of a corresponding cutting block.

9. The stapler as claimed in claim 8, wherein the sliding surface of each cutting block is an inclined surface; and the sliding surface of each guiding block is an inclined surface abutting against the inclined sliding surface on the corresponding cutting block.

10. The stapler as claimed in claim 1, wherein the recoiling device is a spring.

11. The stapler as claimed in claim 1, wherein the connecting bracket has two side plates parallel with each other;

each side plate having a positioning channel aligning with the positioning channel in the other side plate; and the staple magazine is pivotally attached to the connecting bracket between the side plates.

12. The stapler as claimed in claim 11, wherein the handle assembly comprises a handle pivotally attached to the connecting bracket with a second pivot; and a guiding device attached to the handle and having a slider connected to the handle, extending into the staple magazine in a longitudinal direction and having a longitudinal channel along the longitudinal direction; and the driving tab is attached to the slider to push a corresponding staple out of the staple magazine.

13. The stapler as claimed in claim 12, wherein the connecting device comprises a pivotal bracket pivotally attached to the main base with a third pivot and having two pivotal arms, wherein the pivotal arms are located respectively at two sides of the connecting bracket and each pivotal arm has a connecting end away from the third pivot;

two connecting levers pivotally connected to the staple magazine and each connecting lever having a first end, a second end and a middle pivotally connected to the staple magazine with a fourth pivot;

a first sliding pin mounted between the first ends of the connecting levers and slidably extending through the longitudinal channel in the slider;

two second sliding pins attached respectively to the second ends of the connecting levers;

two third sliding pins attached respectively to the connecting ends of the pivotal arms;

a positioning pin mounted between the pivotal arms and extending through the positioning channels in the connecting bracket;

two linkers pivotally and slidably connected respectively to the connecting ends of the pivotal arms of the pivotal bracket with the third sliding pins and each linker having a sliding channel to hold a corresponding second sliding pin and a corresponding third sliding pin inside the sliding channel.

14. The stapler as claimed in claim 1, wherein the arm-lifting top surface is a V-shaped surface.

15. The stapler as claimed in claim 1, wherein each cutting block has a sliding surface formed on the top of the cutting block at a corner away from the other cutting block; and each guiding block has a sliding face formed on the bottom of the guiding block at one end with the guiding top surface and abutting against the sliding surface of a corresponding cutting block.

16. The stapler as claimed in claim 15, wherein the sliding surface of each cutting block is an inclined surface; and the sliding surface of each guiding block is an inclined surface abutting against the inclined sliding surface on the corresponding cutting block.

17. In a stapler having a main base, a pivotal base pivotally attached to the main base and a leg-cutting device, wherein the leg-cutting device comprises:

an upper base securely attached to the pivotal base and having at least one through hole;

two arm holders securely attached to the pivotal base and extending toward the main base;

two pushing arms pivotally connected to the arm holders respectively and each pushing arm having a sliding end and a pushing end;

a lower base securely attached to the main base, corresponding to the upper base and having an arm-lifting top surface, wherein the sliding ends of the pushing arms are slidably attached to the arm-lifting top surface of the lower base to make the pushing arms to move upward when the pivotal base with the arm holders moves downward;

a cutting pad attached to the upper base and having a bottom and a protrusion extending from the bottom to form a first cutting edge at the bottom and a second cutting edge at the protrusion;

two cutting blocks attached respectively to the pushing ends of the pushing arms and aligning with the at least one through hole in the upper base, and each cutting block having an inclined surface formed on the top of the cutting block at a corner away from the other cutting block;

two guiding blocks slidably mounted on the pivotal base and driven by the cutting blocks to move in a lateral direction while the cutting blocks moves, and each guiding block having a curved guiding top surface formed on the guiding block at one end facing to the other guiding block; and two biasing members abutting respectively against the guiding blocks to provide the guiding blocks resilient forces.

18. The stapler as claimed in claim 17, wherein the arm-lifting top surface is a V-shaped surface.

19. The stapler as claimed in claim 17, wherein each cutting block has an inclined surface formed on the top of the cutting block at a corner away from the other cutting block; and each guiding block has an inclined face formed on the bottom of the guiding block at one end with the guiding top surface and abutting against the inclined surface of a corresponding cutting block.

* * * * *